United States Patent [19]

Weis et al.

[11] Patent Number: 4,501,313

[45] Date of Patent: Feb. 26, 1985

[54] TRANSPORT UNIT FOR CASTINGS

[75] Inventors: Martin Weis, Ettlingen; Adolf Scholz, Karlsruhe, both of Fed. Rep. of Germany

[73] Assignee: BMD Badische Maschinenfabrik Durlach GmbH, Fed. Rep. of Germany

[21] Appl. No.: 441,179

[22] Filed: Nov. 12, 1982

[30] Foreign Application Priority Data

Nov. 14, 1981 [DE] Fed. Rep. of Germany ..... 3145316

[51] Int. Cl.[3] ..... B22D 29/00

[52] U.S. Cl. ..... 164/404; 164/269; 164/344

[58] Field of Search ..... 164/269, 270.1, 344, 164/404; 198/480, 481; 29/33 C, 36, 38 C

[56] References Cited

U.S. PATENT DOCUMENTS 2,767,865 10/1956 Lasater ..... 164/269

FOREIGN PATENT DOCUMENTS 2737733 3/1979 Fed. Rep. of Germany ..... 164/404

*Primary Examiner*—Kuang Y. Lin

*Assistant Examiner*—Richard K. Seidel

*Attorney, Agent, or Firm*—Antonelli, Terry & Wands

[57] ABSTRACT

In a foundry apparatus for clearing sand from castings comprising a conveyor and a supporter for the castings and for moving them from the conveyor into an abrasive blasting cabinet (or other sand removing unit) while turning the castings about a horizontal axis, in order to make transport simpler and to make certain that even complex castings are completely cleaned, a transport unit is used for taking up and supporting the castings and is supported on the supporter. The transport unit has a platform-like lower support in the form of a grid to be joined to the supporter by mating parts on the supporter and on the lower support. The mating parts are designed to keep the lower support in a generally horizontal position. The transport unit further is designed for forming a basket with a keeper element on the supporter and the basket is able to be opened and shut.

8 Claims, 3 Drawing Figures

TRANSPORT UNIT FOR CASTINGS

BACKGROUND OF THE INVENTION

The present invention is with respect to a transport unit for castings, covered to a greater or lesser degree with foundry sand, for use in a foundry conveying plant and with a casting supporter for use with the transport unit as part of a blasting apparatus, for the purpose of supporting the castings while they are in the process of being cleaned. The supporter is designed for turning the castings about a generally level axis and furthermore transporting them.

The design of conveying and handling systems in a foundry necessarily has to be complex, because the material to be transported comes in a large number of different forms and different compositions. For example after teeming, the mold flask—or in the case of flaskless systems the foundry sand casing—has to be moved along a cooling path, whereafter the casting or castings are freed as completely as possible of their sand in a shakeout, that may for example have a vibrating screen. Next the castings, that, as noted, may be in a number of widely different forms as for example small flanges or, at the other end of the scale, heavy and complex engine cylinder blocks, are moved into and through a blasting unit, in which, if necessary, they may be turned about their own axes, before they are handed over to a further conveying system for moving them on further to a different processing unit, for example for taking off flash. The different form and nature of the castings make it necessary to have different sorts of conveying mechanisms, of a more or less complex design, along the transport path in question.

A suggestion has been made in the past (see German Offenlegungsschrift specification No. 2,631,385) to have an overhead conveyor running right along this transport path with hanging baskets as transport units for the sand casings with the castings inside them so that at the shakeout station the sand may be cleared from the castings and the castings kept within the baskets for further transport through the blasting cabinet. Because of the basket design it is on the one hand possible for the foundry sand to be cleared from the castings without any trouble in the shakeout, while on the other hand the cleaning jet may readily get to all parts of the castings, the loose sand then falling down from the castings without anything in its way. While it is true that such a design is very much simpler with respect to the conveying apparatus needed, it is of little use in some cases because the castings in the blasting cabinets are not changed in position in relation to (for example by being turned over) the cleaning jets so that, more specially in the case of castings with complex forms and spaces opening in different directions, some core sand may well be kept back in such openings.

On the other hand blasting cabinets are known (see German Auslegeschrift specification Nos. 2,510,827 and 2,613,717) in which the castings, more specially heavy and complex ones such as cylinder blocks and the like, are taken up by a special supporter and transported thereby through the blasting cabinet, the supporter being made up, generally speaking, only of rods, by way of which the castings are supported at a limited number of points so that the casting is not covered up and may be freely acted upon all over by the blasting jet. These supporters for the castings have a drive by which they are kept turning about a roughly horizontal axis so that all points on the casting are acted upon by the cleaning jet, the loosened sand then freely falling out of pockets and holes in the castings. In the one case (see German Auslegeschrift specification No. 2,510,827) the supporter for the castings is in the form of a horizontal tongs, whose jaws are formed by a fixed rod and two rocking rods joined together by a cross-rod. In the other case (see German Auslegeschrift specification No. 2,613,717) the supporter is in the form of a generally horizontal basket cage with a wall across it so that one part thereof may be folded open and shut again, so as to give a further tongs-like mechanism. In such tongs-like supporters the castings are moved along a straight or curved path through the blasting cabinet and at the same time are turned over by a turning drive. This known system does however have the shortcoming again that the conveying systems may not be made uniform or standardized and that the castings each have to be handed over from one part of the plant to another a number of times.

SHORT OVERVIEW OF THE INVENTION

One purpose of the present invention, in connection with the blasting plant of the last-named sort, that as such makes possible complete cleaning even of complex castings, is that of designing a transport unit for moving casings of foundry sand and castings within them in a wide range of different forms and sizes from the cooling path to a point on the far side of the blasting cabinet.

A still further purpose of the present invention is that of designing such a transport unit that may be moved along the complete transport path or conveyor using standardized conveyor systems.

For effecting these and further purposes or objects of the invention such a transport unit is the form of a grid-like lower support which on the one hand takes up the casting and on the other hand has the further function of being transported by the conveyor system, it being designed to be joined up with the supporter by way of mating parts on the supporter and on said lower support and kept in a generally horizontal position thereon, the supporter having a keeper or cover element, that may be rocked or otherwise moved down onto the casting(s) on the lower support into a shut position forming a basket or cage with the casting within it.

At the end of the cooling path the foundry sand casing with the casting within it is pushed off onto the grid-like lower support or is taken up by it and is then moved on by the conveyor system (that from this point onwards is standardized in design) to the shakeout, that may for example be in the form of a grid. Because the lower support itself is grid-like, there is nothing stopping the foundry sand from falling down clear of the casting. Whatever their size and form, the castings are kept on the grid-like supports and moved on them by the standard conveyor system to the blasting cabinet. At this point the lower supports are handed over to the supporter which for this very purpose has the connection system of mating parts for use with a connection on the lower support, the two connection parts coupling the lower support with the supporter, the lower support being kept in a generally horizontal position. Next a cover or keeper element of the supporter is rocked or moved along a straight line towards the lower support and the casting thereon for forming a basket or cage shutting in the casting from all sides. The cage is such that while it may be used for a wide range of different sorts of castings, it is still possible for the casting to be acted upon by the jet of blasting medium while the cage and the casting are being turned over, that is to say turned about a more or less horizontal axis, and moved through the blasting cabinet, the blasting medium furthermore freely running out through the walls of the cage.

As part of one further development of the invention the grid-like lower support is in the form of an upwardly opening basket and the cover or keeper element on the supporter is generally flat so that it may be fitted into the opening of the basket. This form of the invention is more specially useful in foundries in which the forms of the castings are frequently changing, and the lower support may be used for transporting very small castings as well.

In this form of the invention the supporter may have a rocking arm, at whose outer, free end the cover is rockingly fixed, the cover being made up of parallel rods or of a grid. By using a rocking connection between the supporter and the cover it becomes possible to make certain that the rods or the grid making up the cover or keeper element take up a position fitting the casting or its outline and come up against it at a number of points.

In another form of the invention the grid-like lower support is flat and the cover or keeper element, that may be rocked or moved in translation, is in the form of a downwardly opening cage. This form of the invention is more specially of value for handling large castings such as large engine cylinder blocks or the like, seeing that the such large castings may then be placed on and taken off such a flat lower support with simple gear.

Even though it is not necessary in every case, it is nevertheless preferred for the cover to be able to be rocked or moved in translation in relation to the lower support so that the castings are gripped between the two parts and when they are being turned over (by the turning supporter) within the blasting cabinet, they are not moved in relation to the lower support and cover, this being to make certain that all the parts of the casting may be acted upon by the blasting or cleaning jet. However, in the event of there being a number of small castings within the basket (formed by the cover and the lower support), a good effect may be produced by causing tumbling of the castings within the basket. In this case, it will be seen, the castings are not to be gripped between the lower support and the cover or keeper element.

A further useful effect is to be had if the mating parts on the lower support and the supporter for fixing the said support on the supporter are made up of at least one hook on the one and an eye on the other. It will be seen from this that the lower support is simply hooked on the supporter, something which may be undertaken by lifting and lowering the part of the handling system used for handing over the lower support to the supporter. It will then be equally simple for the lower support to be unhooked from the supporter after it has gone through the blasting cabinet.

For producing an even firmer connection between the supporter and the lower support, the last-named may be joined with and supported on the supporter at a point at a lower level than the hook.

Further details and useful effects of the invention will be seen from the account now to be given of some working examples thereof to be seen in the figures.

LIST OF VIEWS OF THE FIGURES

DETAILED ACCOUNT OF WORKING EXAMPLES OF INVENTION

In the figures the reader will only see the abrasive blasting area of a foundry, but it will be clear that the transport units, as may be readily seen from the further account to be given herein, may be used for the transport of castings in flaskless molds, that is to say sand casings, to the shakeout station before transport, after the first stage of cleaning in the shakeout, to the abrasive blasting part of the plant. Furthermore these transport units may be used for further movement of the castings from the blasting plant to, for example, further cleaning stations.

Figure 1:
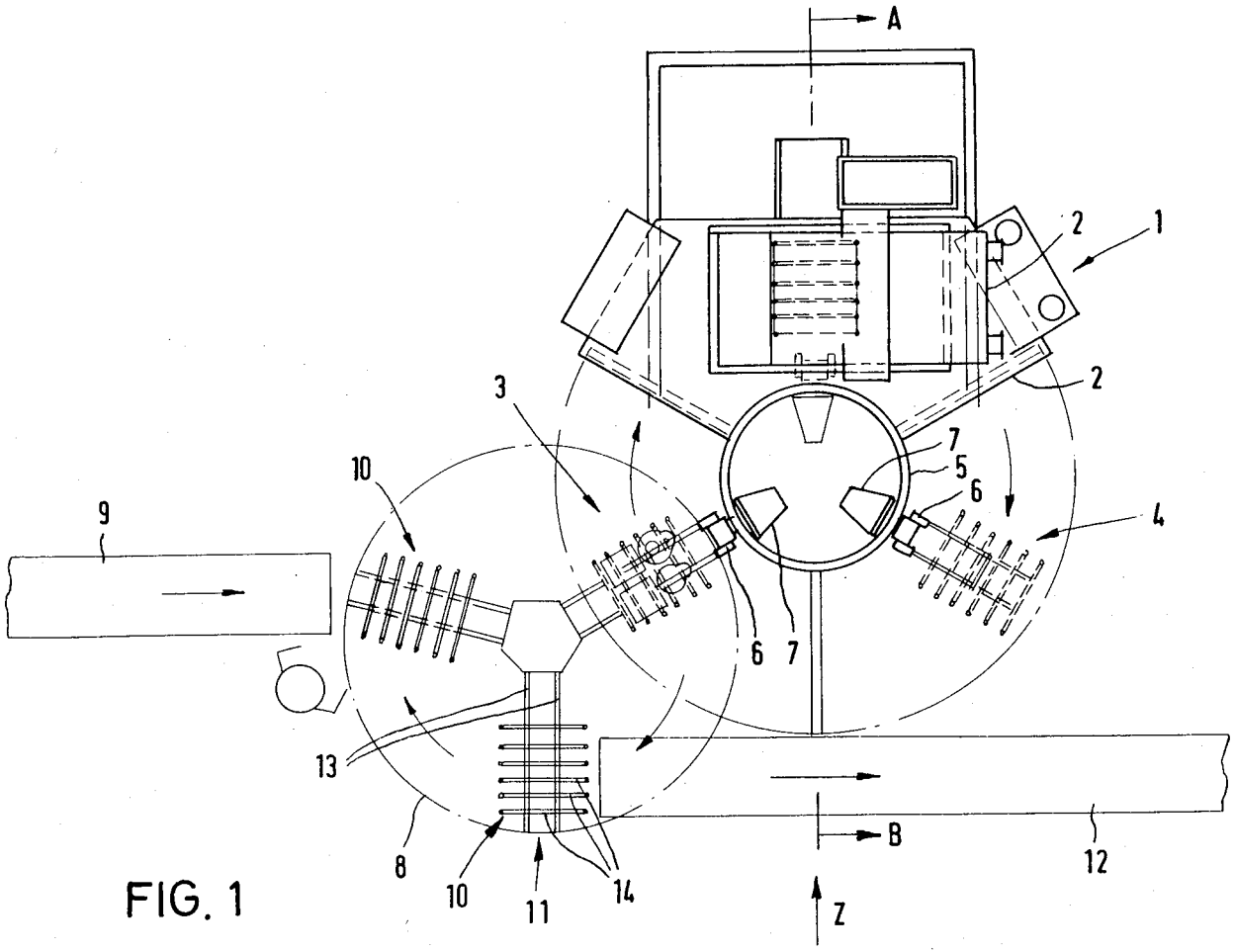
FIG. 1 is a plan view of a single-station abrasive blasting plant with a first example of the invention.

In FIG. 1 the area of a single-station plant 1 will be seen that is made up of a blasting cabinet 2, a loading station 3 and a sand unloading station 4, these three stations each forming one position of a turning or carrousel table 5 over which there are three supporters 6, of which each has a drive 7 for turning it about a horizontal axis and producing a gripping or shutting effect.

In the present working example however the station 4 of the turning table 5 may be used for unloading the castings or, however, giving up the transport units 10. In place of this it is furthermore possible for this station, as is taken to be the case in FIG. 1, to be an idle station or a shut-off station for moving on loose sand and abrasive blasting medium by further turning of the supporter. In this event the transport unit will be given up at the loading station 3 to the turning table 8 and, because the last-named is turned in the opposite direction to the turning table 5, the transport unit 10 is moved into the position 11, while at the same time a further transport unit, having a so far uncleaned casting thereon, will be moved out of the position near the conveyor belt 9 up to the supporter 6, that is still in the loading position 3. The transport unit 10 with the cleaned castings on it may be handed over with the castings to a conveyor 12 at this point. It is however furthermore possible for the castings to be taken from the transport unit 10 at this position 11 and to be placed on the conveyor 12 by themselves. In this even the transport units will be moved back from the position 11 to the shakeout or the cooling path as the case may be.

Figure 2:
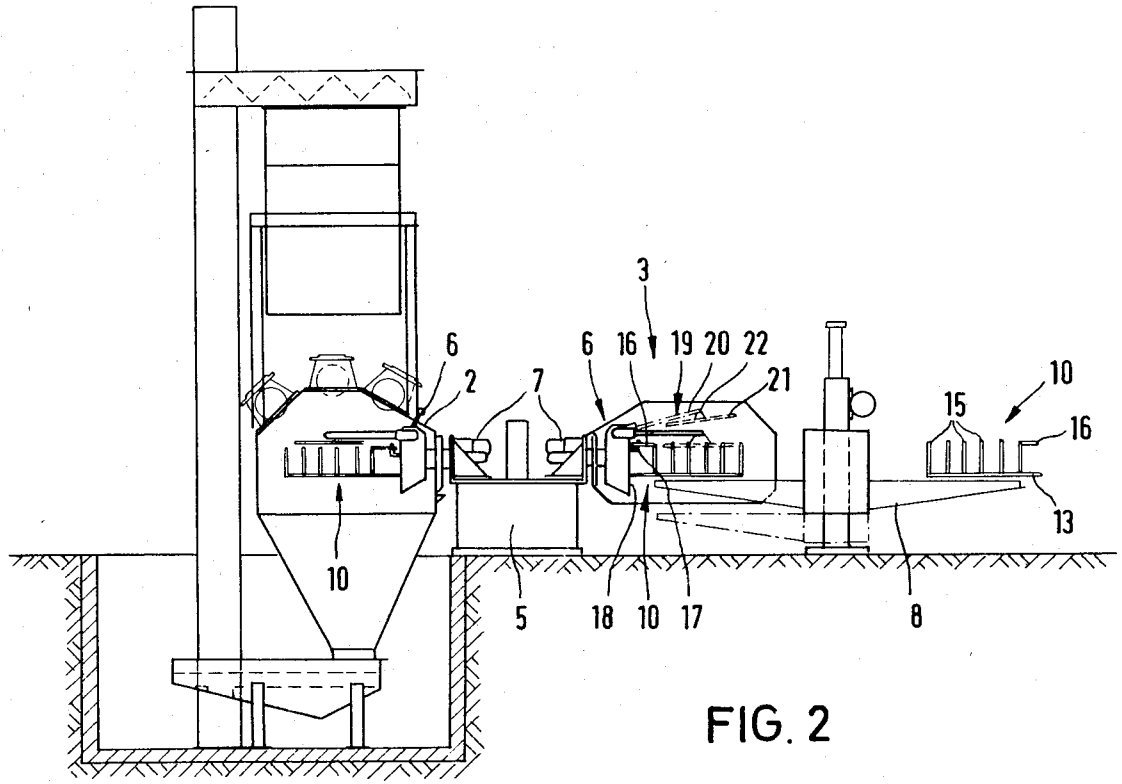
FIG. 2 is a side view of the abrasive blasting plant of FIG. 1.

The transport unit 10 is in the form of a grid-like lower support, that, as will be seen from FIGS. 1 and 2 is made up of two lengthways rods 13 and a number of cross-running rods 14. In the working example of FIGS. 1 and 2 the grid-like lower support 10 (see more specially FIG. 2 on this point) is in the form of an upwardly opening basket, with side walls formed by upwardly pointing rods 15 joined at their lower ends to the cross rods 14 or formed by the cross-running rods being simply bent upwards at their end parts. Furthermore the grid-like lower support 10 has mating parts, for example in the form of eyes 16, at the ends of the lengthways rods 13, for joining the lower support with the supporter 6. The supporter has (see FIG. 2) a mating part 17 in the form of a hook. The hook and the eyes are so placed in relation to the lengthways rods 13 that the last-named will be rested and supported at 18 on the supporter 6.

The supporter 6 is designed in the form of a unit turned about a generally horizontal axis and in addition to the hook 17 has a cover 19 or keeper element that in the present working example is so joined with the rest of the supporter that it may be folded between open and shut positions. The cover has a rocking arm 20 and a number of parallel rods, placed side by side, or a grid 21, that is rockingly joined with the outer or free end of the rocking arm 20 at 22.

The grid-like lower support 10 or base is turned by the transfer unit 8 into the loading station 3 and slipped over the hook 17 of the supporter 6. To make this possible the transfer unit may be lifted and lowered and is in fact lowered into the position marked in chained lines in FIG. 2. The rocking arm is moved downwards so that the rods or the grid as the case may be are pushed down onto the castings. Next the turning table 5 is moved, and with it the supporters 6, so that the castings are moved into the abrasive blasting cabinet 2, where the castings are turned over and over for the abrasive cleaning process.

Figure 3:
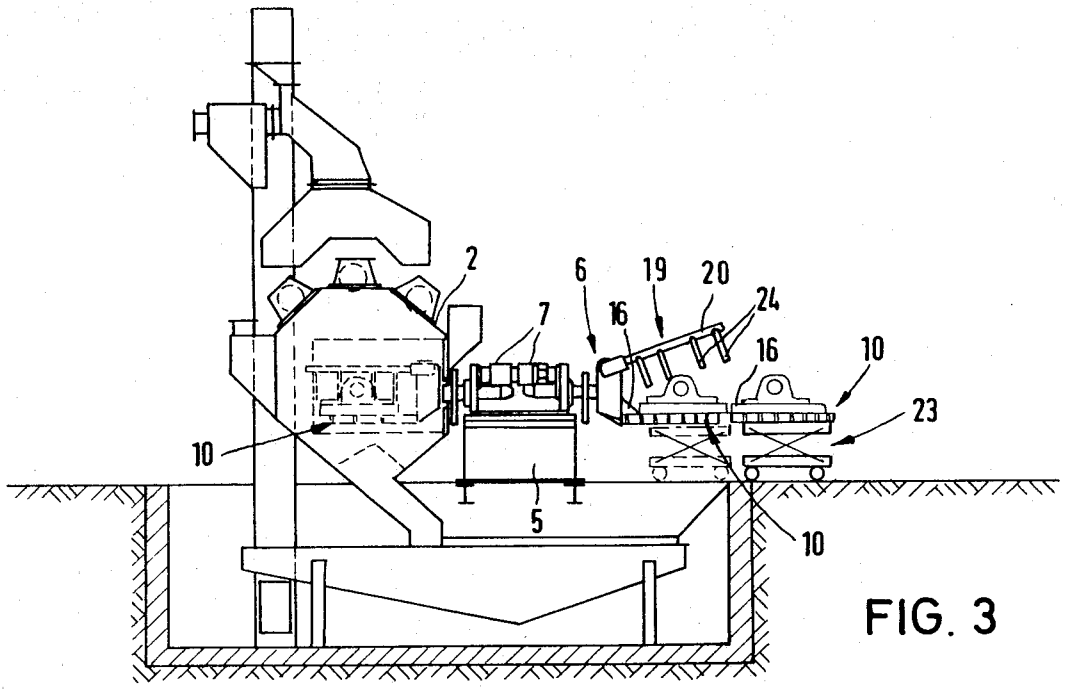
FIG. 3 is a side view of a blasting plant generally like that of FIG. 2, but using a different form of the transport unit.

In the working example viewed in FIG. 3 the grid-like lower support or base 10 is this time in the form of a normal grid or grating and on one side has the mating parts 16 for joining with the supporter 6. For handing over the lower support 10 or transport unit to the supporter 6 it will be seen from FIG. 3 that a traveling table 23 is used, which is wheeled up to the supporter 6 and lowered so that the support 10 thereon is hooked up with the supporter.

The supporter 6 has in this case as well a rocking arm 20, that however unlike the system of FIGS. 1 and 2 is in the form of a downwardly opening cage made up of bars 24 and which in the shut position is fitted round the edge of the flat or grid-like support 10 or is fitted into it.

We claim:

1. In a foundry apparatus for cleaning castings with mold sand adhering thereto, comprising conveyor means for moving a casting to a supporter means for moving said casting from said conveyor means into and through an abrasive blasting apparatus for cleaning mold sand from said casting while rotating said casting about a generally horizontal axis as it is being cleaned in said abrasive blasting apparatus, wherein the improvement comprises a transport means for receiving and supporting said casting as it is moved by said conveyor means to said supporter means, said transport means including a grid-like lower support for said casting and connection means for connecting said transport means to said supporter means, said transport means being held in a generally horizontal position when connected to said supporter means by said connection means, and wherein said supporter means includes a keeper element which is mounted on said supporter means and which forms a basket with said transport means for retaining said casting when said transport means is connected to said supporter means for movement through said abrasive blasting apparatus while being rotated about a generally horizontal axis, said keeper element being mounted on said supporter means for movement relative to said transport means so that said basket can be opened and shut.

2. The foundry apparatus as claimed in claim 1 wherein said transport means is designed in the form of an upwardly opening basket part designed for forming said basket with said keeper element, said element being flat and fitting into said opening of said basket part.

3. The foundry apparatus as claimed in claim 2 having a rocking arm fixed on said keeper element, said element being made up of parallel parts with spaces therebetween.

4. The foundry apparatus as claimed in claim 2 wherein said keeper element of said transport means is in the form of a grid.

5. The foundry apparatus as claimed in claim 1 wherein said transport means is flat and said keeper element therefor is in the form of a downwardly opening cage.

6. The foundry apparatus as claimed in claim 1 wherein said keeper element may be moved towards said lower support far enough for gripping said casting therebetween.

7. The foundry apparatus as claimed in claim 1 comprising on said supporter means and on said transport means a hook and an eye as said connection means for joining same together.

8. The foundry apparatus as claimed in claim 7 wherein said transport means is designed to be supported at a point on said supporter means at a lower level than said hook and eye.

* * * * *